US005152134A

United States Patent [19]

Boyd et al.

[11] Patent Number: 5,152,134

[45] Date of Patent: Oct. 6, 1992

[54] GAS TURBINE ENGINES WITH PARTICLE TRAPS

[75] Inventors: Gary L. Boyd, Tempe; D. Warren Sumner, Phoenix; Yogendra Sheoran, Scottsdale; Z. Daniel Judd, Phoenix, all of Ariz.

[73] Assignee: Allied Signal Inc., Morris, N.J.

[21] Appl. No.: 345,791

[22] Filed: Apr. 28, 1989

[51] Int. Cl.[5] ..... F23R 3/02; F02C 7/30

[52] U.S. Cl. ..... 60/39.092; 60/39.464

[58] Field of Search ..... 60/39.092, 39.464, 39.36; 415/121.2, 121.1, 144, 168.1

[56] References Cited

U.S. PATENT DOCUMENTS

| | | | |
|---|---|---|---|
| 2,476,507 | 7/1949 | Parmele | 60/39.464 |
| 2,575,415 | 11/1951 | Grimac . | |
| 2,635,564 | 4/1953 | Havemann | 60/39.464 |
| 2,706,150 | 4/1955 | Lloyd | 60/39.464 |
| 3,274,757 | 9/1966 | Wapler | 415/121.2 |
| 4,148,186 | 4/1979 | Virr | 60/39.484 |
| 4,184,326 | 1/1980 | Pane, Jr. et al. | 60/757 |
| 4,539,918 | 9/1985 | Beer et al. | 60/39.464 |

FOREIGN PATENT DOCUMENTS

| | | | |
|---|---|---|---|
| 93990 | 9/1988 | Fed. Rep. of Germany . | |
| 640104 | 7/1950 | United Kingdom | 415/121.2 |
| 873592 | 7/1961 | United Kingdom . | |
| 974016 | 11/1964 | United Kingdom . | |
| 1065561 | 2/1967 | United Kingdom . | |

*Primary Examiner*—Richard A. Bertsch
*Assistant Examiner*—Timothy S. Thorpe

[57] ABSTRACT

A gas turbine engine (10) incorporates a particle trap (46) that forms an entrapment region (73) in a plenum (24) which extends from within the combustor (18) to the inlet (32) of a radial-inflow turbine (52, 54). The engine (10) is thereby adapted to entrap particles that originate downstream from the compressor (14) and are otherwise propelled by combustion gas (22) into the turbine (52, 54). Carbonaceous particles that are dislodged from the inner wall (50) of the combustor (18) are incinerated within the entrapment region (73) during operation of the engine (10).

2 Claims, 4 Drawing Sheets

GAS TURBINE ENGINES WITH PARTICLE TRAPS

The government has rights in this invention pursuant to Contract No. DEN 3-335, funded by the Department of Energy, and administered by the National Aeronautics and Space Administration.

TECHNICAL FIELD

The present invention relates generally to gas turbine engines and more particularly to those which incorporate means for minimizing damage that occurs when particles are propelled by combustion gas into the turbine. Still more particularly, the invention relates to gas turbine engines adapted to entrap such particles upstream from the turbine and to incinerate those attributable to carbonaceous accumulations which have dislodged from the inner wall of the combustor.

BACKGROUND OF THE INVENTION

The performance characteristics of a gas turbine engine depend in significant part on the maximum sustainable temperature with which it can be operated while avoiding damage to core components. The maximum sustainable temperature varies with the design of the engine but is fundamentally limited in any conventional design which uses core components constructed from metal alloys. Although such materials have excellent overall properties, their susceptibility to thermally-induced phenomena such as creep imposes an upper limit on operating temperature. This upper limit can be significantly increased by providing means for cooling temperature-limited portions (chiefly, turbine blades) of the engine core. However, even with the use of such expedients, maximum sustainable operating temperatures are typically several hundred degrees below that associated with a stoichiometric combustion process. Thus, the engine is typically powered by combustion of an air/fuel mixture which is more or less fuel-lean, depending on power requirements.

The above-described limitations have led to general recognition that the temperature problem must be solved if large improvements are to be made in the performance of gas turbine engines. This in turn has led to previous and continuing attempts to develop turbine engines that incorporate ceramic core components. Continued development is impeded by the fact that ceramics, although superior to metal alloys in terms of temperature resistance, are far more brittle. A ceramic component can be suddenly destroyed by various particles which may be propelled into the component by combustion gas. These particles may be small metal or ceramic chips dislodged from other components, or carbonaceous particles dislodged from accumulations thereof formed on an inner wall of the combustor. Fuel-rich zones within a combustor may result from a number of causes or may be inherent in the design thereof. Where these zones are sufficiently close to the inner wall of the combustor, carbon liberated by the combustion process accumulates thereon. During operation of the engine, particles dislodge from these accumulated deposits and are propelled by combustion gas into the turbine. The impact of these and the other forementioned particles with components such as turbine blades may result in breakage, and is a major source of failure in engines which are constructed with ceramic components.

Attempts at minimizing this source of failure have included the use of a scrolled duct between the combustor and turbine, whereby a vent opening formed in the radially outer wall of the duct provides for the possible escape of the particles to ambient air. This approach is viewed as unsatisfactory since some of the combustion gas escapes as well, thus lowering the efficiency of the engine.

A brute-force approach in axial-flow turbines has been to provide turbine blades that are sufficiently large and thick to withstand the impact of the particles without sustaining sudden breakage. This approach has the obvious drawbacks regarding weight and aerodynamic efficiency, and is of little value in small gas turbine engines such as those designed for automotive applications, wherein radial-inflow turbines are much more efficient.

Other approaches have focused on the geometry of the turbine wheel (rotor) blades in relation to the direction of inlet air, and have included angling the leading edge of the blades, thus effectively lowering the applicable vector of the impulsive force between the particle and the high-speed blade.

An objective of the present invention is to provide a gas turbine engine in which all or a significantly high percentage of the above-described particles are prevented from reaching the turbine.

Another objective is to provide a gas turbine engine in accordance with the forementioned objective while maintaining a substantially airtight plenum between the combustor and the turbine.

A still further objective of the invention is to provide a gas turbine engine that incorporates a particle trap generally positioned in a plenum extending from within the combustor to the turbine, the engine thereby being adapted to entrap and incinerate particles that dislodge from the inner walls of the combustor before the entrapped particles are propelled into the turbine.

These and further objectives and advantages of the invention will be apparent from the following description, which includes the appended claims and accompanying drawings.

SUMMARY OF THE INVENTION

This invention provides gas turbine engines which incorporate particle traps positioned in a plenum which extends from within the combustor to the inlet of the turbine. The engines are thereby adapted to entrap particles that originate downstream from the compressor inlet, and to incinerate those which are dislodged from carbonaceous accumulations formed on the inner wall of the combustor. The invention should prove especially useful in gas turbine engines having ceramic turbine components, but can be used to advantage in any gas turbine engine wherein the prevention of damage (whether sudden or gradual) resulting from impact by such particles is sought.

The preferred embodiment described hereinafter incorporates a number of improvements on the above-summarized invention. These include the addition of flow deflection means by which particles that would otherwise not be propelled into the particle trap are directed therein.

The forementioned improvements further include means for disrupting vortices of combustion gas that might otherwise propel initially entrapped particles out from an entrapment region and into the remainder of the plenum.

Finally, the improvements include the provision of means for permitting bleed flow of combustion gas from the entrapment region to an area of the plenum which is generally downstream therefrom, but upstream from the turbine. This also assists in preventing initially entrapped particles from re-entering the remainder of the plenum.

DESCRIPTION OF THE PREFERRED EMBODIMENT

Figure 1:
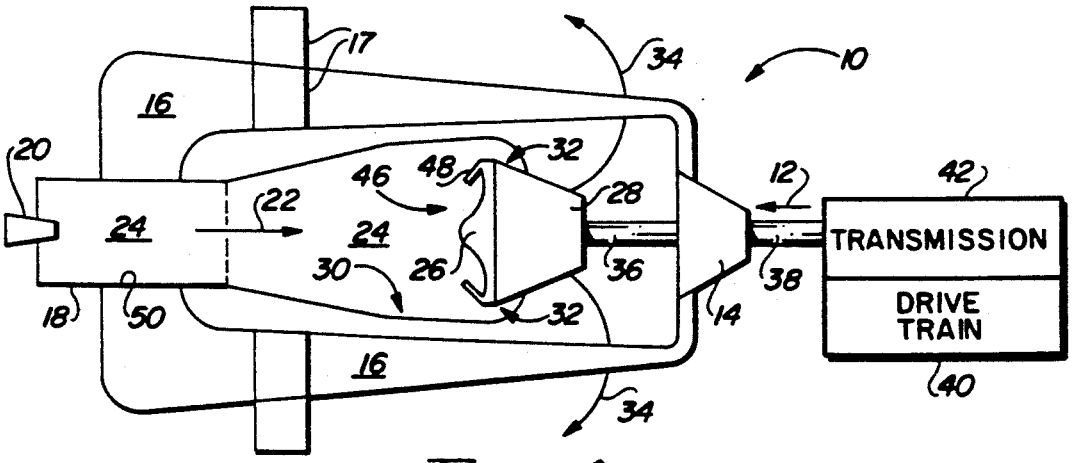
FIG. 1 is a schematic illustration of a gas turbine engine incorporating the present invention and powering the drive train of an automotive vehicle.

FIG. 1 schematically illustrates a gas turbine engine 10. In operation, air inducted into the engine 10 (the inducted air being indicated by arrow 12) is compressed by a centrifugal compressor 14, and from the outlet thereof flows through a diffusion duct 16, a rotating regenerator core 17, and into a combustor 18. Within the combustor 18, the air 12 mixes with fuel delivered via a nozzle 20, and the mixture is burned to produce high-temperature combustion gas (indicated by arrow 22). The combustion gas 22 flows along a plenum 24 which is formed at least in part by the combustor 18 and the backshroud 26 of a radial-inflow turbine 28. (Typically, however, the plenum 24 is formed by additional ducting elements, indicated generally by line 30, between the combustor 18 and the inlet 32 to the turbine 28). The combustion gas 22 undergoes expansion as it flows through the turbine 28 and converts to outlet gas (indicated by curved arrow 34). The undissipated energy associated with the expansion is imparted to the turbine 28, causing both the turbine and the compressor 14 to rotate at high speed, the latter being drivingly engaged with both the turbine (via a shaft 36) and an output shaft 38. The outlet gas 34 flows through a second diffusion duct (not shown) and the regenerator core 17 before escaping to the ambient environment. The regenerator core 17 is driven off the output shaft 38 by conventional means. The output shaft 38 transfers power provided by the engine 10 to the drive train 42 of an automotive vehicle via a transmission 44.

In accordance with the present invention a gas turbine engine, such as the engine 10 illustrated in FIG. 1 for example, incorporates a particle trap 46 and is thereby adapted to entrap particles that originate downstream from the inlet of the compressor 14, and to incinerate those which are dislodged from carbon accumulations formed on the inner wall 50 of the combustor 18.

Figure 2:
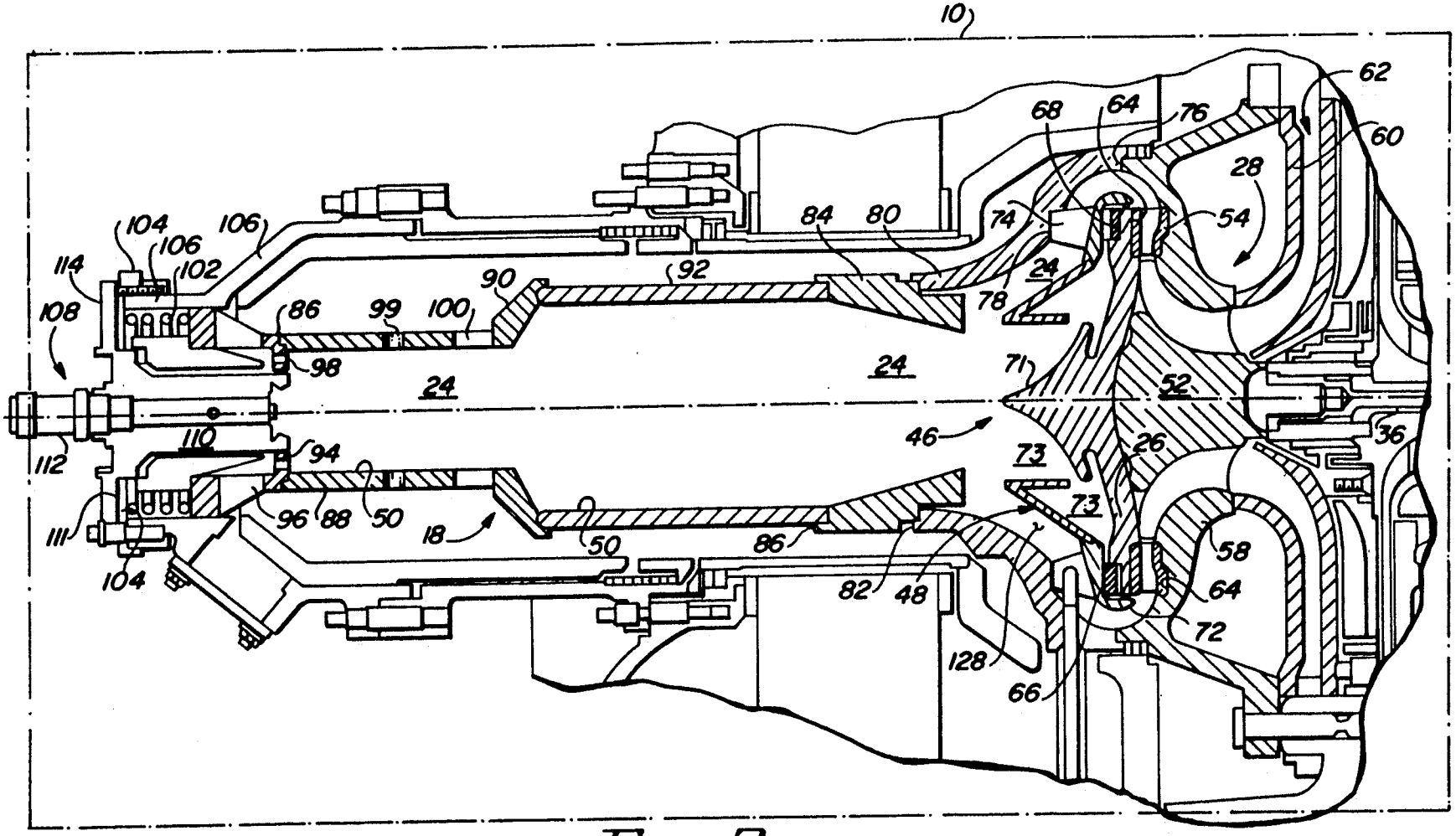
FIG. 2 is a fragmentary cross-sectional view—somewhat schematic—of a gas turbine engine adapted to employ a particle trap in accordance with the preferred embodiment of the invention.

Referring now to FIG. 2, a radial-inflow turbine 28 comprising a rotor or turbine wheel 52 and a stator 54 is axially aligned with a can-type combustor 18 and a particle trap 46. The turbine wheel 52 is rigidly secured to and in engagement with the shaft 36, and is circumferentially surrounded by a generally annular radial shroud 58. The radial shroud 58 is seated on an inner wall 60 of a stationary turbine diffusion duct 62. The stator 54 is seated in an annular recess 64 formed in the radial shroud 58. The backshroud 26 of the turbine wheel 52 has a first annular recess 64 dimensioned as needed to seat the backshroud on the stator 54 while providing a very small clearance between the backshroud and the base of the turbine wheel. A wavespring 66 is seated in a second annular recess 68 formed in the backshroud 26. A generally annular flow splitter 48 is seated on the wavespring 66. The flow splitter 48 cooperates with a centrally-disposed boss 71 of the backshroud 26 to define a generally annular entrapment region 73. A radially outermost portion 72 of the flow splitter 48 overlaps the radially outermost surface of the backshroud 26, and is smoothly contoured to accomodate flow into the stator 54. The flow splitter 48 has three standoff plates 74 circumferentially separated by one hundred twenty degrees. An annular edge 76 of the radial shroud 58 and the free edges 78 of the standoff plates 74 define lands on which a transition duct 80 is seated. The transition duct 80 has a stepped edge 82 forming an inside annular land on which a ramped duct member 84 is seated. Similarly, the ramped member 84 has a stepped edge 86 forming an inside annular land on which the combustor 18 is seated. The combustor 18 is formed from four segments 86, 88, 90, 92. An end segment 86 defines an annular boss 94 and a plurality of circumferentially-spaced ribs 96. The end segment 86 has a plurality of circumferentially-spaced holes (not shown) between the ribs 96, and a plurality of circumferentially-spaced holes 98 formed in the boss 94. The latter holes 98 are drilled at an angle of 45° in relation to the axis of the combustor 18, and are mutually parallel. Air 12 (FIG. 1) enters the combustor 18 via the forementioned holes formed in the end segment 86, and via a plurality of circumferentially-spaced holes 99 and slots 100 formed in the cylindrical segment 88. A coil spring 102 is seated on the end segment 86, and an annular end cap 104 is pressed axially inwardly (to the right in FIG. 1) against the force of the wavespring 66 and the coil spring 102. The end cap 104 is rotated so that a plurality of circumferentially-spaced holes formed therein are aligned with an associated plurality of threaded bores formed in the engine case 106. The end cap 104 is then bolted to the engine case 106, and the entire assembly of elements forming the combination of the plenum 24 and the particle trap 46 is held in place by compression. In the embodiment of FIG. 2, that assembly includes the combustor 18, the ramped member 84, the transition duct 80, the radial shroud 58, the backshroud 26, and the flow splitter 48. A nozzle structure 108 comprising a nozzle 110, a seal 111, and an ignitor 112 is positioned as indicated. The nozzle 110 has a flange 114 in which a plurality of circumferentially-spaced holes are formed. The structure 108 is rotated so that these holes are aligned with similarly-spaced holes and threaded bores formed in the end cap 104 and engine case 106, respectively, and is bolted to the engine case. This permits removal of the nozzle structure 108 without decompression of the components which form the plenum 24 and particle trap 46. All cross-hatched components illustrated in FIG. 1 are made of a silicon nitride or silicon carbide ceramic so that the engine 10 can be operated at very high temperatures more closely corresponding to a stoichiometric combustion process.

Figure 3:
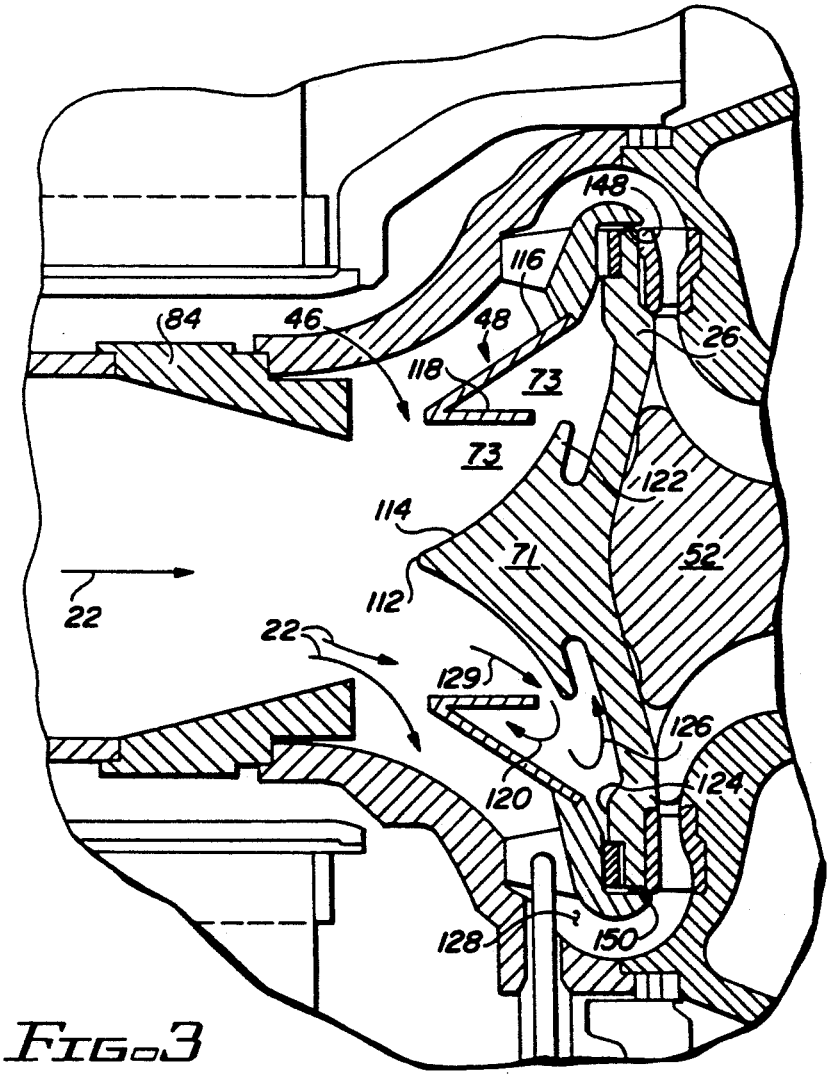
FIG. 3 is an enlargement of a portion of FIG. 2, illustrating certain features of the particle trap.

Referring now to FIG. 3, it can be seen that the centrally-disposed boss 71 of the backshroud 26 is approximately conical in shape and defines an apex 112. The outer surface 114 of the boss 71 is radially concave and converges to the apex 112 in a direction which is upstream in reference to the flow of the combustion gas 22. The flow splitter 48 defines a first generally annular wall portion 116 that circumferentially surrounds the boss 71 to define the entrapment region 73, and converges in generally the same direction as the outer surface 114. (The entrapment region 73, although given a separate numeral in the drawings to aid clear description, is a radially bounded portion of the plenum 24.) The flow splitter 48 further defines a second generally cylindrical wall portion 118 spaced from the outer surface 114 and extending from the first wall portion 116 back into the entrapment region 73 in a direction which is generally toward the outer surface. The second wall portion 118 serves the purpose of breaking-up vortices (indicated by arrow 120) of combustion gas 22 which tend to propel entrapped particles back into the main flow path of the combustion gas 22. An annular secondary boss 122, extending in a generally radial direction from the remainder of the centrally-disposed boss 71 and slightly toward the base 124 of the backshroud 26, serves the similar purpose of breaking-up vortices indicated by the numeral 126. The wavespring 66 is slightly raised with respect to the adjacent upstream-facing surface 146 of the backshroud 26. The flow splitter 48, although in close-fitting relationship with the annular, radially-outer surface 75 of the backshroud 26, does not form an airtight seal therewith. The radially outermost portion 72 of the flow splitter 48 has a plurality of circumferentially-spaced nubs 148 which abut the radially outermost surface 150 of the backshroud 26. The combustion gas 22 flows at high velocity along the annular portion 128 of the plenum 24 and into the stator 54. This creates a low-pressure region in the annular portion 128 near the interface between the flow splitter 48 and the radially outermost surface 150 of the backshroud 26. The comparatively higher pressure in the entrapment region 73 permits bleed flow of combustion gas 22 from the entrapment region to the annular portion 128, just upstream from the stator 54. This bleed flow assists in preventing initially entrapped particles from being propelled back into the remainder of the plenum 24. An alternative is to provide orifices in the flow splitter 48 or backshroud 26, the orifices being appropriately sized to prevent propulsion therethrough of all but innocuously small particles.

As has been explained above, operating any gas turbine engine over an extended period of time can be expected to result in a buildup of carbonaceous material on the inner wall of the combustor. Referring to FIGS. 2 and 3, during operation of the engine 10, particles from this buildup become dislodged from the inner wall 50 and are propelled along the plenum 24 by the combustion gas 22. Other particles may enter the plenum 24 via the holes 98, 99, 100 formed in the combustor 18, or by normal wearing of the plenum-forming elements. The particles are propelled generally toward the particle trap 46. However, particles that remain near the radial periphery of the plenum 24 will, in the absence of the ramped member 84, miss the trap 46 and be propelled into the turbine 28 along a portion 128 of the plenum that surrounds the flow splitter 48. It is estimated that the particle trap 46 illustrated in FIGS. 2 and 3 will entrap fifty percent of the particles if the ramped member 84 is not provided. Particles that remain near the radial periphery of the plenum 24 are directed by the ramped member 84 in a generally radially-inward direction and toward the entrapment region 73. The particles are deflected from and propelled along the outer surface 114, and through an opening (indicated by arrow 129) formed between the outer surface and the second wall portion 118. The carbonaceous particles dislodged from the inner wall 50 of the combustor 18 are incinerated in the entrapment region 73 by the combustion gas 22. Any remaining particles are periodically removed from the trap 46 during normal engine maintenance.

A rig test of the combination of the particle trap 46 and ramped member 84 (as illustrated in FIG. 2) showed success in entrapping approximately 90% (by weight) of the particles. However, it is stressed that the ramped member 84 is an improvement on the basic invention of a gas turbine engine which incorporates an appropriately positioned particle trap and is thereby adapted to entrap particles otherwise propelled into the turbine, whereby in operation of the engine, entrapped carbonaceous particles are incinerated. Other improvements include the provision of the second wall portion 118 of the flow splitter 48, the provision of the secondary boss 122, and the provision of means for permitting bleed flow of combustion gas from the entrapment region 73 to portion of the plenum 24 which is generally downstream from the entrapment region but upstream from the turbine 28. The latter is further described hereinafter. Other embodiments of the invention will now be briefly described with reference to FIGS. 4 and 5.

Figure 4:
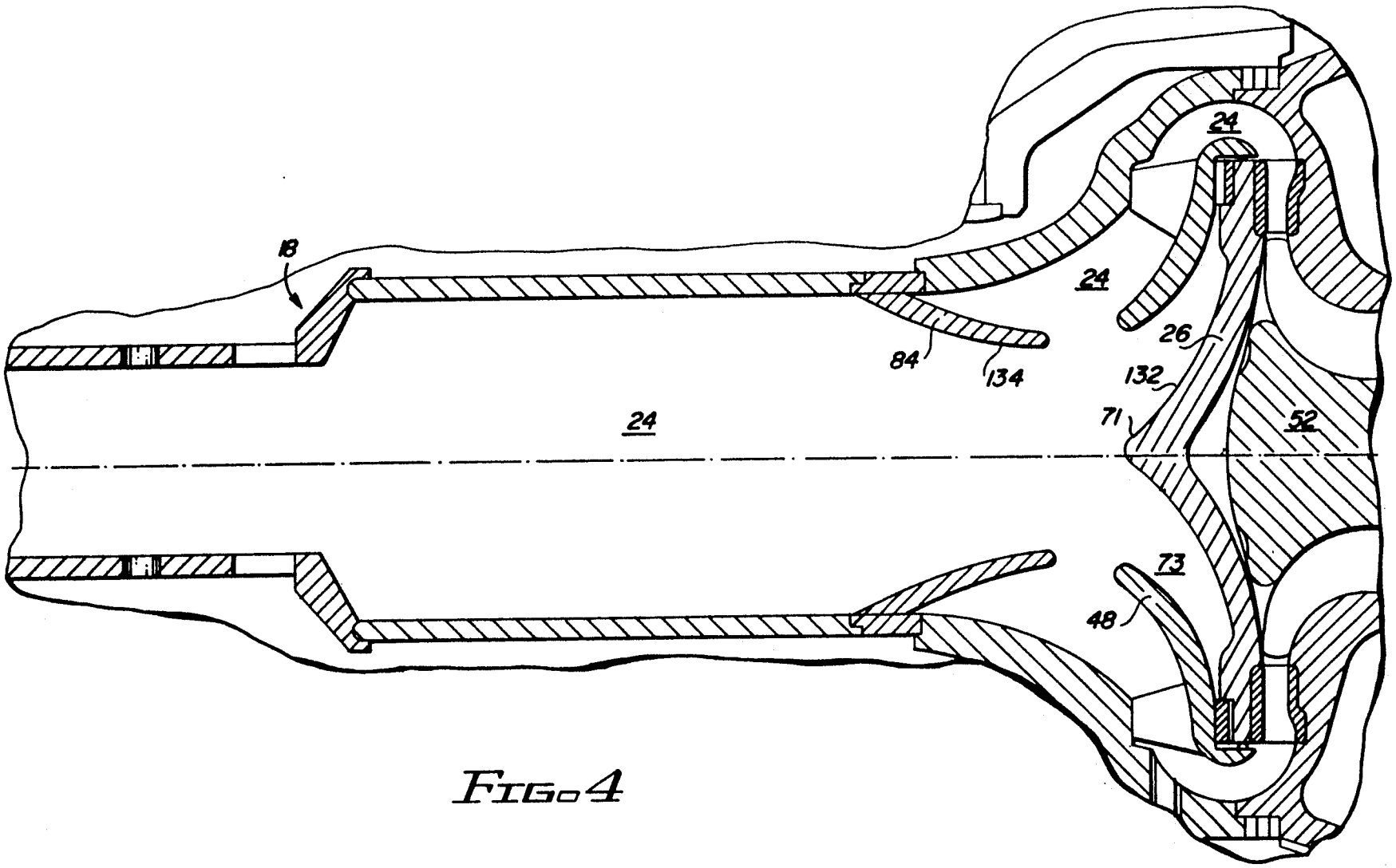
FIGS. 4 and 5 are fragmentary cross-sectional views as in FIG. 2, and illustrate two additional embodiments of the particle trap.

FIG. 4 illustrates the original embodiment of the particle trap 46 which comprised a backshroud 26 having a concave surface 132 which converged to form a centrally-disposed boss 71, and a generally annular flow splitter 48. A ramped member 84 having a convex surface 134 formed a portion of the plenum 24 adapted to direct particles into the entrapment region 73. A rig test of the combination of the trap 46 and the ramped member 84 (as illustrated in FIG. 4) demonstrated success in entrapping only about 5–10 percent of the particles.

Figure 5:
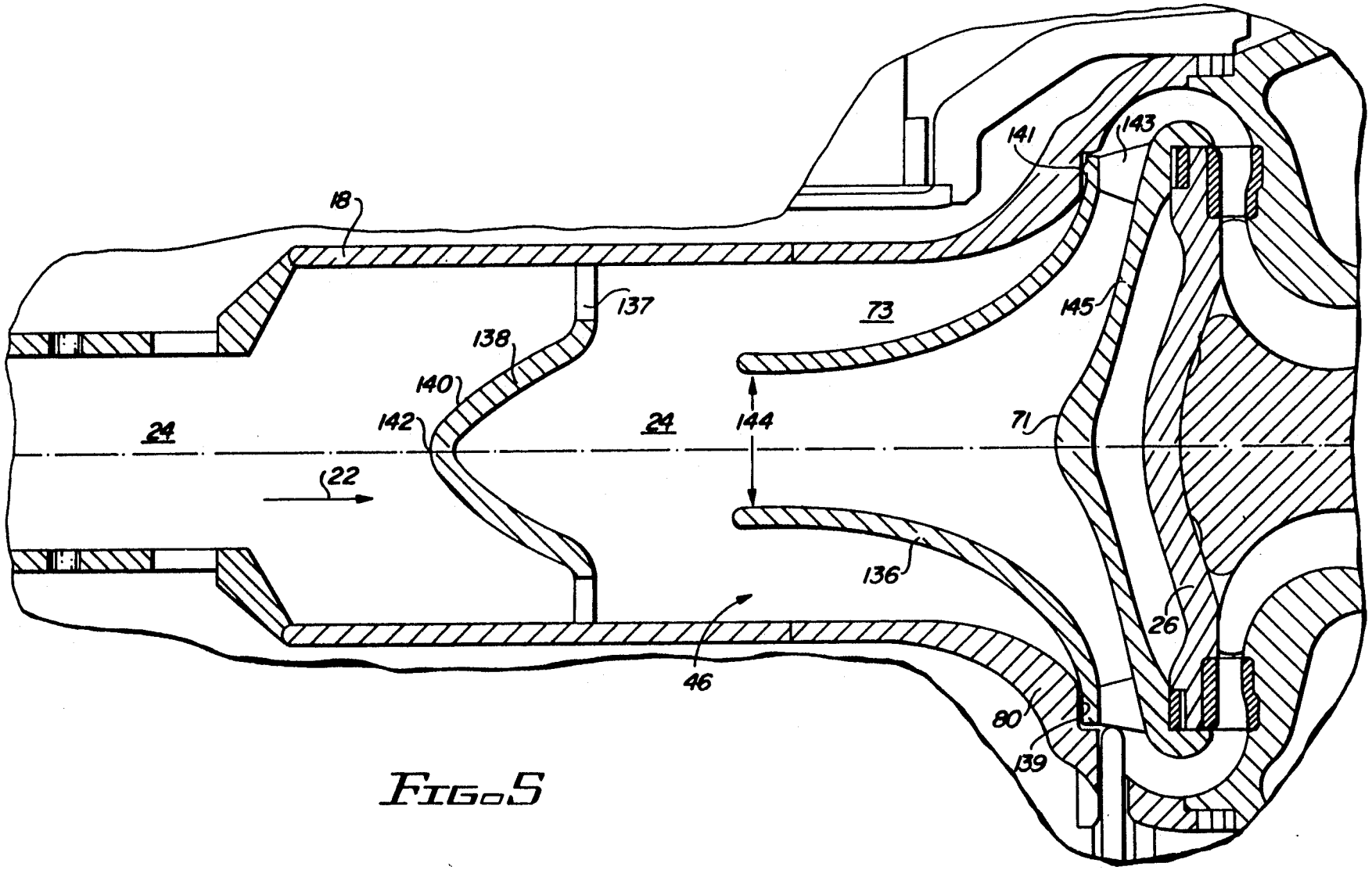

FIG. 5 illustrates another contemplated embodiment of the invention in which the entrapment region 73 is formed by a generally annular wall 136 extending from the radially peripheral extreme of the plenum 24. The wall 136 extends in an upstream direction in reference to the flow path of the combustion gas 22 and converges in a radially-inward direction in reference to the plenum 24. The wall 136 bears against an annular land 139 formed in the transition duct 80, and is held in place by standoff plates 143 extending from a generally conical member 145 secured by suitable means to the backshroud 26. The wall member 136 has a plurality of circumferentially-spaced nubs 141 providing spacing to permit bleed flow from the entrapment region 73 to a portion of the plenum 24 which is downstream therefrom. Secured by suitable means (as by circumferentially-spaced standoff plates 137, for example) to the combustor 18 or other plenum-forming component is a generally conical deflector 138 having a surface 140 which converges in an upstream direction to form an apex 142. The deflector 138 is positioned upstream from the wall 136, and the surface 140 forms an angle with respect to the center of the plenum 24 such that particles which would otherwise be propelled through the open central area (indicated by arrows 144) defined by the annular wall are deflected from the surface into the entrapment region 73. The particle trap 46 illustrated in FIG. 5 has not been tested separately from the deflector 138. However, it is assumed that it will perform approximately as well as the trap 46 illustrated in FIG. 2, where the latter is unassisted by the ramped member 84. Simulation testing of the combination of the particle trap 46 (FIG. 5) and the deflector 138 indicates that an engine incorporating that combination should successfully entrap approximately as high a percentage of particles as does the combination of the trap 46 and ramped member 84 illustrated in FIG. 2.

The above description of various embodiments of the invention and improvements thereon is intended as illustrative rather than restrictive. Accordingly, the invention should be construed as broadly as is consistent with the following claims and their equivalents.

What is claimed is:

1. A gas turbine engine that comprises in combination:

a combustor adapted to burn a mixture of fuel and air to form combustion gas, the combustor having an inner wall;

a radial-inflow turbine;

means, including said combustor, for forming a plenum extending from within said combustor to an inlet of said turbine;

means secured within said engine for forming a generally annular entrapment region within said plenum, whereby in operation of said engine, particles propelled along said plenum by said combustion gas are entrapped within said region;

means for permitting bleed flow of said combustion gas from said region to a portion of said plenum positioned generally downstream from said region-forming means but upstream from said turbine; and means, radially centered in reference to said plenum and fixedly positioned upstream from said annular wall, for deflecting particles propelled by said combustion gas in a radially-outward direction toward said region.

2. A gas turbine engine as in claim 1 wherein said deflecting means comprises a member having a generally conical surface that converges in a direction which is upstream in reference to flow of said combustion gas, said member being secured to said plenum-forming means.

* * * * *